US005486648A

United States Patent [19]

Chan et al.

[11] Patent Number: 5,486,648

[45] Date of Patent: Jan. 23, 1996

[54] POWER CABLE WITH LONGITUDINAL WATERBLOCK ELEMENTS

[75] Inventors: John C. Chan, Scarborough; Hossein Compani, North York, both of Canada

[73] Assignee: Alcatel Canada Wire Inc., Canada

[21] Appl. No.: 223,639

[22] Filed: Apr. 6, 1994

[30] Foreign Application Priority Data

May 12, 1993 [CA] Canada ..... 2096066

[51] Int. Cl.[6] ..... H01B 7/28

[52] U.S. Cl. ..... 174/23 R; 174/105 SC; 174/106 SC; 174/108

[58] Field of Search ..... 174/23 R, 23 C, 174/106 SC, 105 SC, 102 SG, 108

[56] References Cited

U.S. PATENT DOCUMENTS

| | | | |
|---|---|---|---|
| 4,703,134 | 10/1987 | Uematsu | 174/106 SC |
| 4,815,813 | 3/1989 | Arroyo et al. | 174/23 C |
| 4,909,592 | 3/1990 | Arroyo et al. | 174/23 R |
| 4,913,517 | 4/1990 | Arroyo et al. | 174/70 S |
| 5,010,209 | 4/1991 | Marciano-Agostinelli et al. . | |
| 5,146,946 | 9/1992 | Arroyo et al. . | |
| 5,157,752 | 10/1992 | Greveling et al. | 385/112 |
| 5,264,251 | 11/1993 | Geursen et al. | 174/23 C |
| 5,300,733 | 4/1994 | Uematsu | 174/106 SC |

FOREIGN PATENT DOCUMENTS

| | | | |
|---|---|---|---|
| 3013954 | 10/1981 | Germany | 174/23 C |
| 3115990 | 11/1992 | Germany | 174/23 R |
| 2225480 | 5/1990 | United Kingdom | 174/23 R |

*Primary Examiner*—Morris H. Nimmo

*Attorney, Agent, or Firm*—Ware, Fressola, Van Der Sluys & Adolphson

[57] ABSTRACT

An electric power cable is provided having concentric neutral wires (CN wires) applied helically over the cable core construction to serve as a metallic ground shield and having a protective polymeric jacket over the CN wires. The cable is characterized in that at least one continuous, elongated water swellable element, such as yarn, filament, strand or strip is provided in contact with the CN wires and is so disposed in relation thereto as to block the passage of water within the cable in the longitudinal direction.

29 Claims, 8 Drawing Sheets

POWER CABLE WITH LONGITUDINAL WATERBLOCK ELEMENTS

BACKGROUND OF THE INVENTION

This invention relates to electrical power cables which have concentric neutral wires (CN wires) applied helically over the cable core as a metallic ground shield which is then covered by a protective polymeric jacket. More particularly, the invention relates to an improved protection against migration of water in such power cables by providing suitable continuous, elongated water swellable elements, such as yarns, filaments, strands or strips in contact with the CN wires and so disposed in relation to said CN wires as to block the passage of water within the cable in the longitudinal direction.

A power cable is a long, cylindrically symmetric structure with a dielectric which operates at relatively high electrical stress. It normally consists of a metallic conductor covered with a semi-conductive shield (i.e. conductor stress control layer), over which a solid dielectric (i.e. insulation), such as a crosslinked polyethylene (XLPE) or ethylene propylene rubber (EPR), is extruded. This solid dielectric is covered with a semi-conductive shield (i.e. insulation stress control layer), thus forming a cable core on which a metallic ground shield is applied. The preferred metallic shield, particularly for medium voltage underground distribution cables, consists of CN wires applied helically over the cable core and over which an overall polymeric jacket is extruded to provide protection against radial moisture ingress into the insulation. The grounded metallic shield serves the following functions: (a) to provide a neutral current return path and to ensure that the outside surface of the cable insulation is at ground potential; and (b) to provide a preferred path to ground for any fault currents and to ensure tripping of protective devices.

It is known that moisture ingress into the insulation can result in the formation of "water trees" which shorten cable life significantly. Water trees are diffused structures or micro-channels with a bush like or fan-like appearance. They grow from defects such as voids, contaminants and semi-conductive shield protrusions in the presence of water and an electric field. The overall protective polymeric jacket, provided over the metallic shield, has a positive effect in minimizing tree growth. However, buried, underground distribution cables sometimes experience mechanical damage to the jacket during installation or subsequent accidental dig-ins, allowing ground water to migrate under the jacket. This almost unlimited supply of water can result in the accelerated growth of water trees in the affected section of the cable. In addition, the length of cable exposed to this accelerated tree growth is increased due to water migration along the longitudinal axis of the cable. Obviously, the probability of cable failure will increase as the length of the affected section increases. One approach for limiting the affected area is to use an encapsulating jacket over the concentric neutral (CN) wires to minimize longitudinal water migration over the entire length of the installed cable. Unlike the conventional "sleeve" jacket, the encapsulating jacket is designed to fill the spaces between the concentric neutral wires. While the encapsulating jacket is an improvement over the "sleeve" jacket in terms of resistance to longitudinal water migration, it is not entirely effective in that some water leakage occurs along the slight grooves or indentations made by the concentric neutral wires and/or at the interface between the cable core and the jacket. The water leakage can be observed when the cable is tested in accordance with the water penetration test procedure specified in industry specifications such as International Electrotechnical Commission (IEC) 840 (Amendment 1).

It is already known to use a water swellable material in an electrical power cable to provide a water barrier under the jacket of such cable. For example, U.S. Pat. No. 5,010,209 issued Apr. 23, 1991, discloses use of water swellable particles, namely powder, or of a filling compound with such particles or of a water swellable tape or a combination of these to provide such barrier. However, in the construction using CN wires, referred to as wire serving, as shown in FIGS. 6 to 8 of said U.S. Pat. No. 5,010,209, a layer of water swellable particles is always provided. The use of water swellable powder presents a number of disadvantages. When working with such powder, dust particles are spread in the air and they may cause a flash fire in the presence of a flame. Such dust may also cause respiratory problems and/or eye irritation. Moreover, surfaces subject to spills or dusting can become slippery when wet, resulting in unsafe work areas.

The use of a layer of water swellable tape over the length of the cable increases the overall diameter and weight of the cable which, in many instances, is undesirable. Also, the cost associated with the application of water swellable tape and powder is significant and will translate into a higher cost of the cable.

U.S. Pat. No. 5,146,046 issued Sep. 8, 1992 discloses the use of two water swellable strand-like members, such as yarns, wrapped in opposite helical directions between the relatively supple core wrap layer and the smooth, relatively rigid jacket of a communication cable. The major difference between the communication cable of U.S. Pat. No. 5,146,046 and the electrical power cable of the present invention is that the latter requires the use of CN wires and of a protective plastic jacket as part of the insulation shield system. The use of strand like members such as shown in U.S. Pat. No. 5,146,046, in a communication cable without the CN wires, does not provide any indication of water blocking capability of such strands in a power cable with a ground shield consisting of CN wires.

OBJECTS AND SUMMARY OF THE INVENTION

It is an object of the present invention to provide a satisfactory longitudinal waterblock in an electrical power cable having concentric neutral wires (CN wires) as the metallic ground shield, by providing at least one continuous elongated water swellable element, such as a yarn, filament, strand or strip in contact with the CN wires and so disposed in relation to said CN wires that upon swelling it would block the passage of water in longitudinal direction when combined with a protective polymeric jacket covering the CN wires. Such a protective polymeric jacket is preferably an encapsulating jacket extruded over the CN wires.

Other objects and advantages of the present invention will become apparent from the following description.

Essentially, there is provided in accordance with the present invention an electrical power cable having concentric neutral wires (CN wires) applied helically over a cable core construction to serve as a metallic ground shield, and having a protective jacket, preferably an encapsulating jacket, over said CN wires, characterized in that at least one continuous, elongated water swellable element, such as yarn, filament, strand or strip is provided in contact with the CN wires and is so disposed in relation to said CN wires as to block the passage of water within the cable in the longitudinal direction.

For example, the water swellable element can be helically wound around the core construction under the CN wires with a lay opposite to that of the CN wires thereby criss-crossing said CN wires. This is the simplest arrangement which provides a notable improvement in longitudinal waterblock effectiveness in a simple and efficient manner, particularly in combination with an encapsulating jacket, since it is very straight forward to wind such elements on the core before applying the CN wires. When water penetrates into the cable through a damaged encapsulating jacket, as mentioned above, it can travel through the groves formed by the CN wires and when it encounters the water swellable element thus positioned in relation to said groves, the element, such as yarn and the like, will swell and block further passage of water in the longitudinal direction.

Also, the water swellable element may be helically wound over the CN wires again with a lay opposite to that of the CN wires, thereby again criss-crossing said CN wires. It is preferred to wind the element in this manner, in relatively loose fashion, so that it conforms to the periphery of the CN wires. To get even better protection, one such element may be wound under the CN wires and another over the wires both with a lay opposite to that of the wires. The elements are preferably wound with a number of helical turns that varies from 1 to 30 per meter of the cable. This dual winding of the swellable elements can be used in combination with a sleeve jacket as well as an encapsulating jacket. Moreover, even though the application of a water swellable tape over the entire length of the cable is often not desirable for reasons already mentioned above, such tape can be applied over the CN wires in accordance with this dual winding embodiment of the present invention, particularly when a sleeve jacket is used.

In a further embodiment, one water swellable element may be wound on the cable core under the CN wires with a lay opposite to that of the CN wires while at least one other such element may be wound on the core parallel to the CN wires. This provides improved protection in the event some water gets between the CN wires. In this case the second element has essentially the same lay length as the CN wires.

In a still further embodiment of the invention the water swellable element may be helically wound around each CN wire. It is so wound preferably with at least one turn per meter of the wire but preferably between 1 and 30 turns.

Moreover, there could be any desired combination of these arrangements, for example by winding one water swelling element around the core under the CN wires and/or over the CN wires and others around each CN wire. When the elements are wound around each CN wire they will normally be pre-applied onto the CN wires prior to the final application of the ground shield consisting of such CN wires onto the cable core.

The water swellable element, such as yarn, filament, strand or strip may be non-conductive or semi-conductive. The reason for which it can be non-conductive is that the CN wires will still maintain a substantial (over 90%) contact with the semi-conductive insulation shield of the cable core on which the CN wires are applied. This is different from the use of the tape covering the entire cable core and which must be semi-conductive to maintain such electrical contact.

Continuous, elongated, water swellable elements such as yarns, filaments, strands or strips are known in the art. They are usually made of polyester fibres treated with a super-absorbent, water swellable agent consisting, for example, of particles or powder of a polyacrylamide based material, of a starch-graft copolymer of polyacrylic acid and polyacrylamide, of carboxymethyl cellulose, and the like. For example, one type of such yarn is sold under the trade name "First Water Swellable Yarn" by Lantor BV of The Netherlands. The yarn or other round elements should preferably have a dry diameter ranging from 0.3 mm to 5.5 mm. When flat elements are used, they are normally cut from a jumbo roll of such material into strands or strips of a dry width of at least 2 mm and preferably ranging from 2 mm to 60 mm , depending on the diameter of the cable core on which they are to be wound. Different types and sizes of elements can be used in constructions where more than one such element is employed. The water swelling elements suitable for the purposes of the present invention should normally have at least 50% swelling capability. Also if semi-conductive materials are desired, the elements would normally be loaded with carbon black.

The cable core construction of electrical power cables in accordance with this invention will usually comprise: a solid or stranded conductor, made for example of copper (Cu) or aluminum (Al) wires; a semi-conductive shield layer which is also referred to as a conductor stress control layer and which is a thin layer of a semi-conductive polymeric compound, such as semi-conductive cross-linked polyolefin (eg. XLPE, EPR, ethylene vinyl acetate, etc.) extruded over the conductor; a layer of insulation extruded over said shield layer and made of a polymeric material such as polyethylene, XLPE, ethylene propylene rubber (EPR) or the like; and a semi-conductive insulation shield over said layer of insulation which is also referred to as an insulation stress control layer and is a thin layer of a semi-conductive polymeric compound, such as semi-conductive polyolefin (eg. XLPE, EPR, ethylene vinyl acetate, etc.), extruded over the insulation. In modern, solid dielectric power cable, the conductor shield, insulation and insulation shield are normally applied in a single pass.

The invention will now further be described and illustrated with reference to the appended drawings, in which:

DETAILED DESCRIPTION OF THE INVENTION

Figure 1:
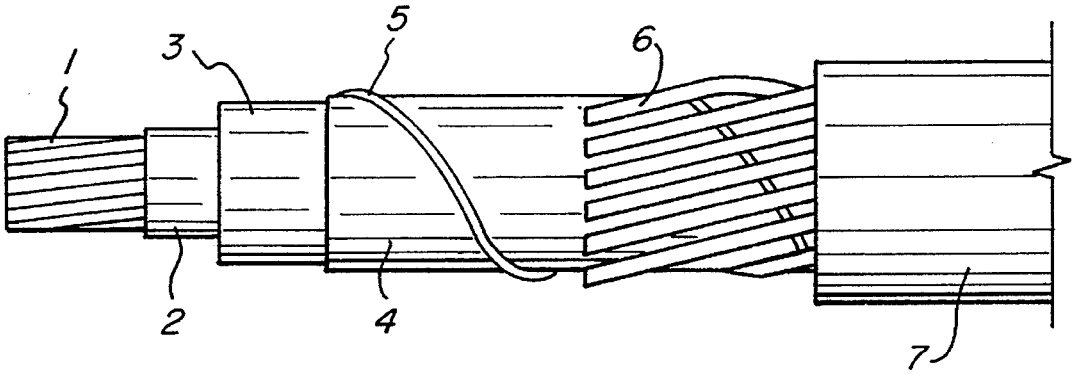
FIG. 1 is a side view of one embodiment of the invention showing a power cable with a water swellable yarn wound around the core of the cable under the CN wires in opposite direction to the CN wires.
Figure 2:
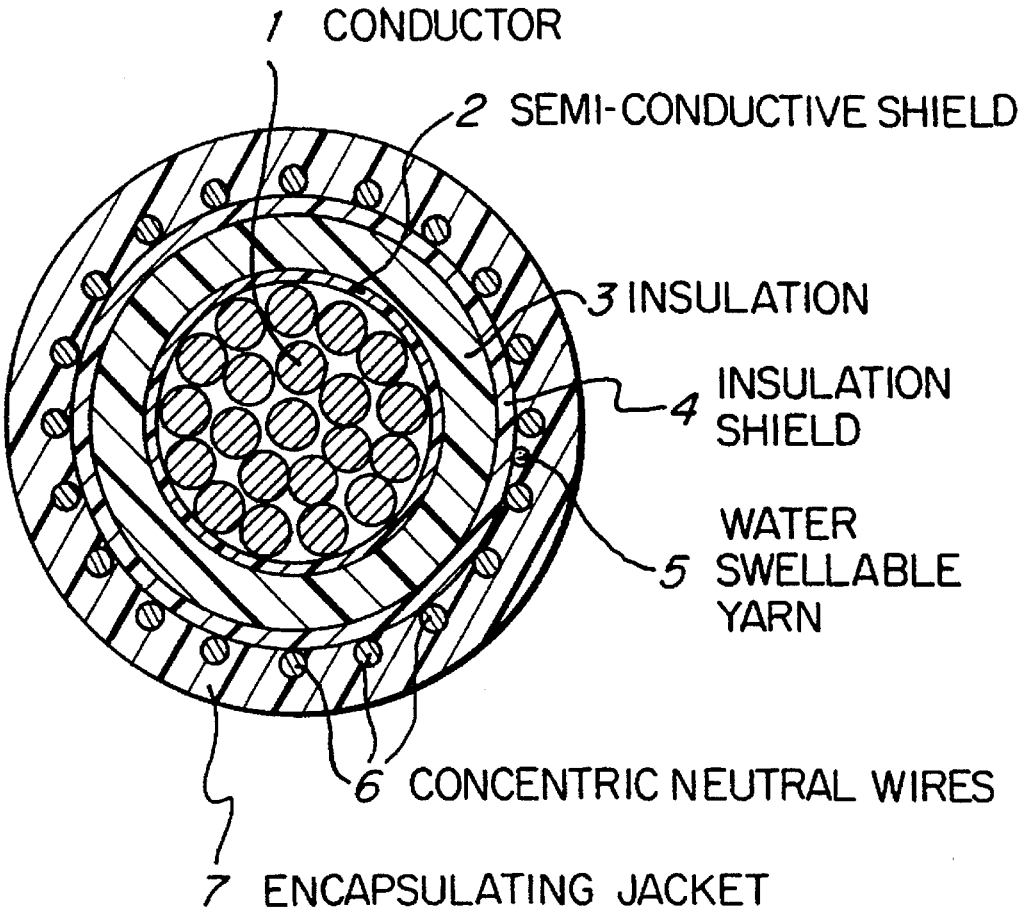
FIG. 2 is a cross-sectional view of the same cable as shown in FIG. 1.

Referring now to FIGS. 1 and 2, they illustrate a longitudinal section and a cross-section respectively of an electrical power cable according to one embodiment of the present invention. In these figures a conductor 1 is shown to be a stranded conductor which can be made of Cu or Al wires. Preferably a conductor is used whose interstices are filled with a compound that prevents migration of moisture along the interstices thereof, such as the one sold under the trademark STRANDBLOCK® by Alcatel Canada Wire Inc., the assigner herein. Conductor 1 is covered by semi-conductive shield 2 which is a thin layer of semi-conductive polymeric compound, such as semi-conductive XLPE, extruded over the conductor. The semi-conductive shield 2 is covered with insulation layer 3 of a polymeric material such as polyethylene, XLPE or EPR, which itself is covered by insulation shield 4 which is a thin layer of a semi-conductive polymeric compound extruded over the insulation 3. The water swellable yarn 5 is helically wound over the insulation shield 4 under CN wires 6 with a lay opposite to that of said CN wires 6 so that it criss-crosses the same as shown in FIG. 1. The CN wires 6 are generally copper or aluminum wires or straps wrapped helically around and in intimate contact with the insulation shield 4. When reference is made herein to the water swellable yarn 5, it should be understood that it may be replaced by any continuous, elongated water swellable element, such as a filament, a strand, a strip or the like, which is preferably applied with a number of turns ranging from 1 to 30 per meter of cable or of the cable core which consists of parts 1, 2, 3, and 4. On top of CN wires 6, there is extruded an encapsulating jacket 7 made of a polymeric material such as a linear low density polyethylene, medium density polyethylene or semi-conductive polyethylene.

Figure 3:
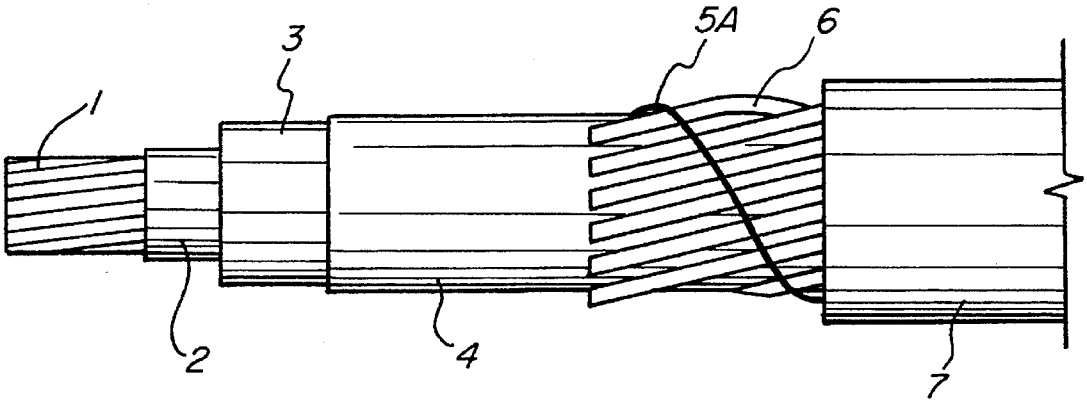
FIG. 3 is a side view of a power cable in which the water swellable yarn is wound over the CN wires in opposite direction to the CN wires.

The embodiment shown in FIG. 3 has the same reference numbers as in FIG. 1 however, here, instead of yarn 5 helically wound under CN wires 6, there is provided a water swellable yarn 5A which is helically wound over CN wires 6 with a lay such that it criss-crosses said wires. The rest of the construction remains the same.

Figure 4:
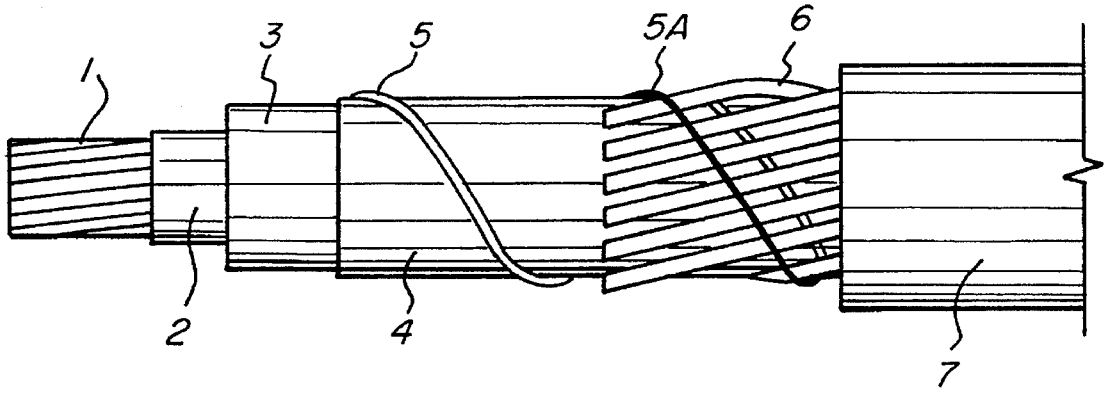
FIG. 4 is a side view of a power cable in which one water swellable yarn is wound under the CN wires and another one over said CN wires both in opposite direction to the CN wires.

In FIG. 4 again the same reference numbers as used in FIGS. 1 and 3 are employed to designate the same parts, except that here two water swellable yarns 5 and 5A are used, one of which is helically wound under the CN wires 6 and the other over said CN wires 6, both being wound with a lay opposite to that of CN wires 6 and both criss-crossing the said wires.

Figure 5:
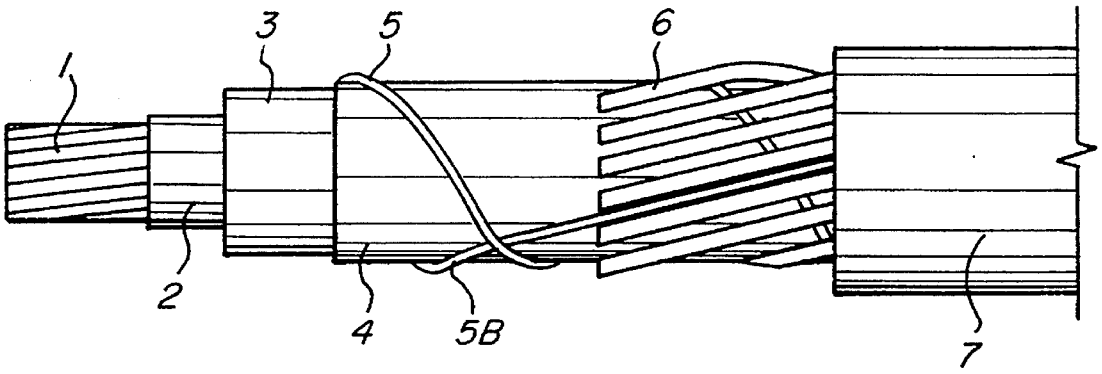
FIG. 5 is a side view of a power cable in which one water swellable yarn is wound under the CN wires in a direction opposite to that of the CN wires and another is wound in the same direction as the CN wires.

FIG. 5 again shows another embodiment of the invention wherein the same reference numbers represent the same parts as in the previous figures, however there is provided here a second water swellable yarn 5B wound on insulation shield 4 parallel to CN wires 6 and criss-crossing yarn 5. This embodiment provides enhanced protection when water penetrates between CN wires 6.

Figure 6:
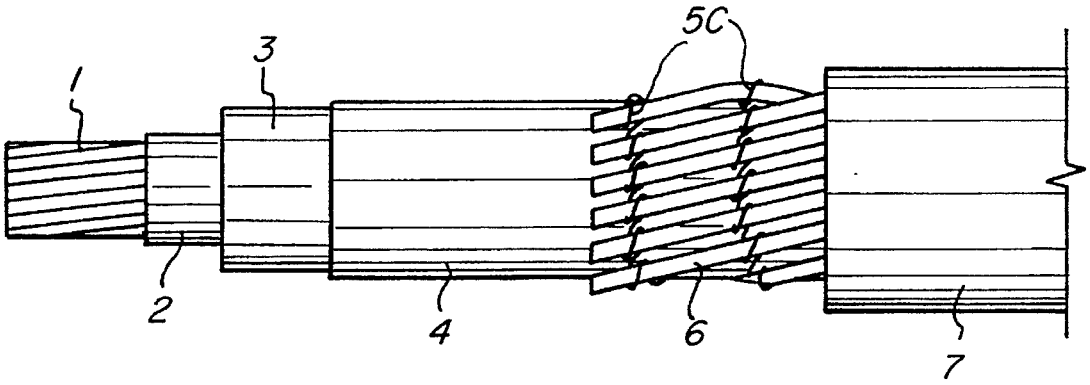
FIG. 6 is a side view of a power cable in which the water swellable yarn is wound around each CN wire.
Figure 7:
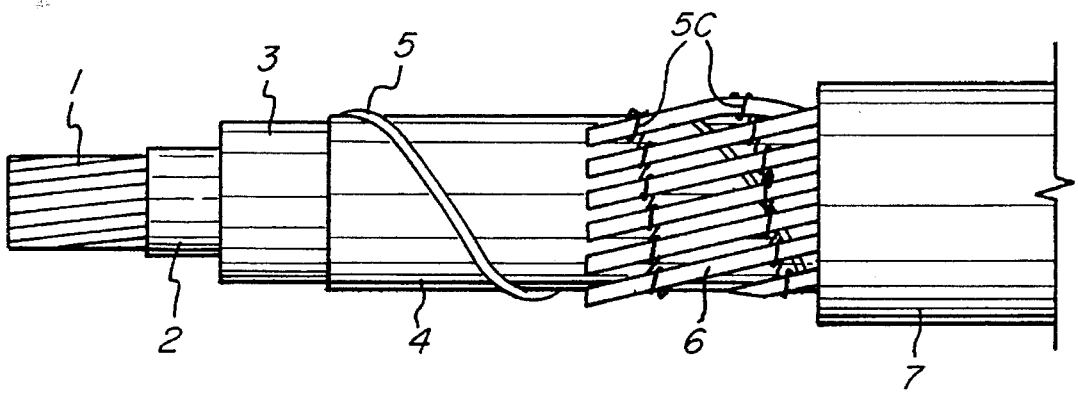
FIG. 7 is a side view of a power cable in which the water swellable yarn is wound around the core of the cable under the CN wires in opposite direction to the CN wires, and other such yarns are wound around each CN wire.

In FIG. 6 a water swellable yarn 5C is wound around each CN wire 6, which constitutes another embodiment of this invention, and in FIG. 7 such yarn 5C wound around every CN wire is provided in addition to yarn 5 wound around the cable core under CN wires 6. It should be noted that when yarn 5C is used, it is normally pre-applied on CN wires 6.

Figure 8:
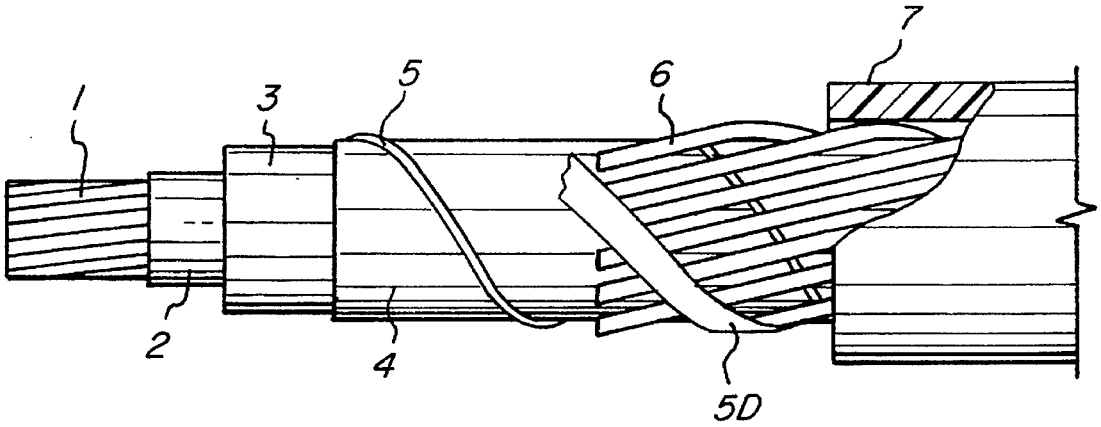
FIG. 8 is a side view of a power cable in which a water swellable tape is applied over the CN wires and at least one water swellable element is wound around the cable core under the CN wires.

Referring to FIG. 8, in yet another embodiment of the invention, the same reference numbers represent the same parts as in the previous figures. In this embodiment, there is provided a water swellable tape 5D applied over CN wires 6 and at least one water swellable element 5 wound around the cable core under CN wires 6. The protective polymeric jacket 7 is a sleeve jacket.

It has been found that the use of continuous, elongated water swellable elements in accordance with the present invention provides excellent protection against water migration in the longitudinal direction when the outer jacket is damaged or the like. It also avoids the disadvantages of known constructions which use particles or powder that can be hazardous and which are difficult to apply. Moreover, the arrangement according to the invention provides an improved construction in relation to the one that would use only tapes over the entire length of the cable.

It Should be understood that only preferred embodiments of the invention have been described and illustrated herein and that a number of modifications that would be obvious to those skilled in this art can be made without departing from the spirit of the invention and the scope of the following claims.

What is claimed is:

1. An electrical power cable having concentric neutral wires applied helically over a cable core construction extending in a longitudinal direction to provide a metallic ground shield, and having a protective polymeric jacket over said concentric neutral wires, characterized in that at least one continuous elongated water swellable element, chosen from a group consisting of yarn, yarn, filament, strand and strip, is provided in contact with the concentric neutral wires and is so disposed in relation to said concentric neutral wires as to block passage of water within the cable in the longitudinal direction.

2. An electrical power cable according to claim 1, in which the protective polymeric jacket is an encapsulating jacket extruded over said concentric neutral wires.

3. An electrical power cable according to claim 2, in which said at least one water swellable element includes a water swellable element helically wound around the cable core construction under the concentric neutral wires with a lay opposite to that of the concentric neutral wires, thereby criss-crossing said concentric neutral wires.

4. An electrical power cable according to claim 2, in which said at least one water swellable element includes a water swellable element helically wound over the concentric neutral wires with a lay opposite to that of the concentric neutral wires, thereby criss-crossing said concentric neutral wires.

5. An electrical power cable according to claim 4, in which the water swellable element is wound in a loose fashion so that it conforms to the periphery of the concentric neutral wires.

6. An electrical power cable according to claim 1, in which said at least one water swellable element includes a first water swellable element helically wound around the cable core construction under the concentric neutral and a second water swellable element wound over the concentric neutral wires, both said water swellable elements being wound with a lay opposite to that of the concentric neutral wires, thereby criss-crossing the same.

7. An electrical power cable according to claim 6, in which the protective polymeric jacket is a sleeve jacket.

8. An electrical power cable according to claim 1, in which said at least one water swellable element includes one water swellable element helically wound around the cable core construction under the concentric neutral wires with a lay opposite to that of the concentric neutral wires and at least one other water swellable element wound around the cable core construction with the same lay as and parallel to the concentric neutral wires.

9. An electrical power cable according to claim 1, in which the at least one water swellable element is a water swellable element helically wound around each concentric neutral wire.

10. An electrical power cable according to claim 3, in which said at least one water swellable element additionally includes an elongated water swellable element, chosen from a group consisting of yarn, filament, strand and strip, which is helically wound around each concentric neutral wire.

11. An electrical power cable according to claim 4, in which said at least one water swellable element additionally includes an elongated water swellable element, chosen from a group consisting of yarn, filament, strand and strip, which is helically wound around each concentric neutral wire.

12. An electrical power cable according to claim 6, in which said at least one water swellable element additionally includes an elongated water swellable element, chosen from a group consisting of yarn, filament, strand and strip, which is helically wound around each concentric neutral wire.

13. An electrical power cable according to claim 8, in which said at least one water swellable element additionally includes an elongated water swellable element, chosen from a group consisting of yarn, filament, strand and strip, which is helically wound around each concentric neutral wire.

14. An electrical power cable according to claim 9, in which the water swellable element wound around each concentric neutral wire is wound with at least one turn per meter of the wire.

15. An electrical power cable according to claim 3, in which each helically wound element is wound with a number of helical turns that varies from 1 to 30 per meter of cable.

16. An electrical power cable according to claim 4, in which each helically wound element is wound with a number of helical turns that varies from 1 to 30 per meter of cable.

17. An electrical power cable according to claim 6, in which each helically wound element is wound with a number of helical turns that varies from 1 to 30 per meter of cable.

18. An electrical power cable according to claim 1, in which the water swellable element is made of non-conductive material.

19. An electrical power cable according to claim 1, in which the water swellable element is made of semi-conductive material.

20. An electrical power cable according to claim 1, in which the water swellable element is made of polyester fibers treated with a super-absorbent, water swellable agent.

21. An electrical power cable according to claims 20, in which the super-absorbent, water swellable agent is selected from a group consisting of a polyacrylamide compound, a starch-graft copolymer of polyacrylic acid and polyacrylamide, and carboxymethyl cellulose.

22. An electrical power cable according to claim 20, in which the water swellable element is loaded with carbon black so as to be semi-conductive.

23. An electrical power cable according to claim 1, in which the water swellable element has at least 50% swelling capability.

24. An electrical power cable according to claim 1, in which the water swellable element is of round construction and has a dry diameter ranging from 0.3 mm to 5.5 mm.

25. An electrical power cable according to claim 1, in which the water swellable element is of flat construction and has a dry width that varies from 2 mm to 60 mm, depending on the diameter of the cable core.

26. An electrical power cable according to claim 1, in which at least one water swellable element is wound around the cable core construction under the concentric neutral wires and a water swellable tape is applied over the entire length of the cable over the concentric neutral wires.

27. An electrical power cable according to claim 26, in which the protective polymeric jacket is a sleeve jacket.

28. An electrical power cable according to claim 1, in which the cable core construction comprises a solid conductor, a semi-conductive shield layer around said conductor, a layer of insulation around said shield layer and a semi-conductive insulation shield over said layer of insulation.

29. An electrical power cable according to claim 1, in which the cable core construction comprises a stranded conductor, a semi-conductive shield layer around said conductor, a layer of insulation around said shield layer and a semi-conductive insulation shield over said layer of insulation.

* * * * *

UNITED STATES PATENT AND TRADEMARK OFFICE

CERTIFICATE OF CORRECTION

PATENT NO. : 5,486,648

DATED : January 23, 1996

INVENTOR(S) : John Chung Chan and Hossein Compani

It is certified that error appears in the above-indentified patent and that said Letters Patent is hereby corrected as shown below:

Claim 1, col. 6, line 31, delete the second "yarn,".

Signed and Sealed this

Eleventh Day of June, 1996

*Attest:*

*Attesting Officer*

Bruce Lehman

BRUCE LEHMAN

*Commissioner of Patents and Trademarks*